US007710332B2

(12) United States Patent
Chen et al.

(10) Patent No.: US 7,710,332 B2
(45) Date of Patent: May 4, 2010

(54) MOBILE COMMUNICATIONS DEVICE WITH A COMPACT-SIZED THREE-DIMENSIONAL ANTENNA

(75) Inventors: Min-Che Chen, Taoyuan (TW); Ching-Sung Wang, Taoyuan (TW)

(73) Assignee: HTC Corporation, Taoyuan, Taoyuan County (TW)

( * ) Notice: Subject to any disclaimer, the term of this patent is extended or adjusted under 35 U.S.C. 154(b) by 40 days.

(21) Appl. No.: 11/889,974

(22) Filed: Aug. 17, 2007

(65) Prior Publication Data

US 2009/0046023 A1 Feb. 19, 2009

(51) Int. Cl.
*H01Q 1/38* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS

| | | | | |
|---|---|---|---|---|
| 2004/0090372 | A1 * | 5/2004 | Nallo et al. | 343/700 MS |
| 2005/0190107 | A1 * | 9/2005 | Takagi et al. | 343/702 |
| 2006/0220965 | A1 * | 10/2006 | Pathak et al. | 343/702 |
| 2007/0152894 | A1 * | 7/2007 | Sanz et al. | 343/702 |

* cited by examiner

*Primary Examiner*—Rexford N Barnie
*Assistant Examiner*—Thienvu V Tran
(74) *Attorney, Agent, or Firm*—Birch, Stewart, Kolasch & Birch, LLP

(57) ABSTRACT

A mobile communications device includes a circuit board and a monopole antenna. The monopole antenna includes a feed part electrically connected to the circuit board and directed away from the circuit board at an acute angle, a connecting part extending from the feed part in a direction substantially perpendicular to the circuit board, a first radiating part extending from the connecting part, and a second radiating part also extending from the connecting part.

22 Claims, 4 Drawing Sheets

MOBILE COMMUNICATIONS DEVICE WITH A COMPACT-SIZED THREE-DIMENSIONAL ANTENNA

BACKGROUND OF THE INVENTION

1. Field of the Invention

The invention relates to a mobile communications device, and more particularly to a mobile communications device with a compact-sized three-dimensional antenna.

2. Description of the Related Art

Internal antennas are increasingly popular and widely used in mobile communications devices (e.g. cellular phones). Recently, planner inverted F antennas (PIFAs) and monopole antennas have become available.

A planner inverted F antenna is required to be spaced apart from a circuit board of a mobile communications device at a predetermined vertical distance, and no electronic components are allowed between the planner inverted F antenna and the circuit board. However, the allotted antenna area and predetermined vertical distance are limited by the dimensions of the mobile communications device which is generally compact. As a result, the performance of the antenna measured in frequency width, radiation efficiency, and gain is hindered.

Similar with PIFAs, a monopole antenna is required to be spaced apart from a circuit board of a mobile communications device at a predetermined distance. However, the predetermined distance is horizontal, and also no electronic components are allowed between the monopole antenna and the circuit board. That is, a clearance zone is required between the monopole antenna and the circuit board to avoid negative disturbances to the monopole antenna. Generally, the clearance zone required by a monopole antenna exceeds 15 mm, a significantly large space when considering compact communication devices.

BRIEF SUMMARY OF THE INVENTION

The invention provides a monopole antenna requiring only a 6.8 mm clearance zone from the circuit board, thus eliminating clearance zone space, which can be used for arrangement of other electronic components in a mobile communications device or further device shrinkage.

The mobile communications device in accordance with an exemplary embodiment of the invention includes a circuit board and a monopole antenna. The monopole antenna includes a feed part electrically connected to the circuit board and directed away from the circuit board at an acute angle, a connecting part extending from the feed part in a direction substantially perpendicular to the circuit board, a first radiating part extending from the connecting part, and a second radiating part also extending from the connecting part.

The above-mentioned mobile communications device can be modified in various ways. In another exemplary embodiment of the invention, for example, the acute angle is about thirty degrees.

In another exemplary embodiment of the invention, as another example, the second radiating part includes a first strip substantially parallel to the first radiating part.

In another exemplary embodiment of the invention, the first radiating part is about 1 mm from the first strip of the second radiating part.

In another exemplary embodiment of the invention, the first radiating part is wider than the first strip of the second radiating part.

In another exemplary embodiment of the invention, the first radiating part is about 2 mm in width.

In another exemplary embodiment of the invention, the first strip of the second radiating part is about 0.8 mm in width.

In another exemplary embodiment of the invention, the second radiating part further includes a second strip extending from the first strip toward the feed part.

In another exemplary embodiment of the invention, the second strip of the second radiating part runs substantially parallel to the first radiating part.

In another exemplary embodiment of the invention, the mobile communications device further includes a mount with the monopole antenna affixed thereto.

In another exemplary embodiment of the invention, the mount is made of plastic.

In another exemplary embodiment of the invention, the monopole antenna is affixed to the mount by ultrasonic heat staking.

In another exemplary embodiment of the invention, the monopole antenna is disposed at a bottom of the communications device.

In another exemplary embodiment of the invention, the circuit board is about 6.8 mm from an edge of the circuit board of the communications device.

In another exemplary embodiment of the invention, the mobile communications device further includes a screw affixing the feed part of the monopole antenna to the circuit board.

In another exemplary embodiment of the invention, the monopole antenna is made of phosphor bronze.

The monopole antenna is capable of operating at a frequency of 824-894 MHz, 880-960 MHz, 1710-1880 MHz, and 1850-1990 MHz. Following experimentation, the monopole antenna of the invention requires only a 6.8 mm clearance zone from the circuit board, thus eliminating clearance zone space, which can be used for arrangement of other electronic components in the mobile communications device or further device shrinkage.

Furthermore, the monopole antenna made of phosphor bronze shows stable operating performance and is inexpensive. In addition, the monopole antenna is affixed to the plastic mount by ultrasonic heat staking, thus effectively simplifying the structure of the mobile communications device.

The feed part of the monopole antenna is firmly connected to the circuit board by a screw, which is easy and fast during assembly. Furthermore, such a connection is reliable. Even when the mobile communications device impacts the ground, the monopole antenna does not separate from the circuit board.

Meanwhile, the positioning of the monopole antenna, disposed at the bottom of the mobile communications device, is distant from the receiver, thus significantly reducing specific absorption rate (SAR) in the human body.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
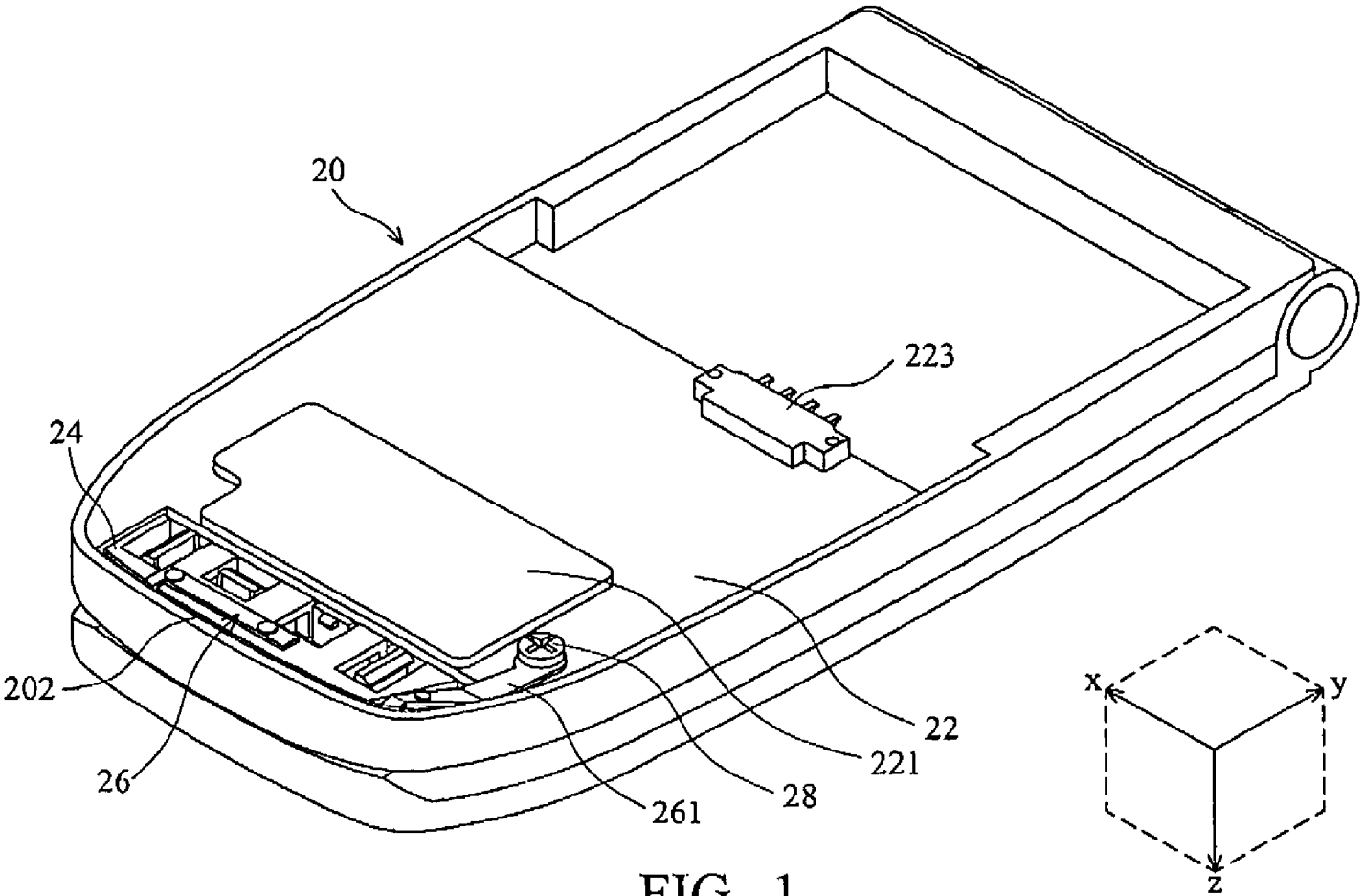
FIG. 1 depicts the rear of a mobile communications device in accordance with the invention.
Figure 2:
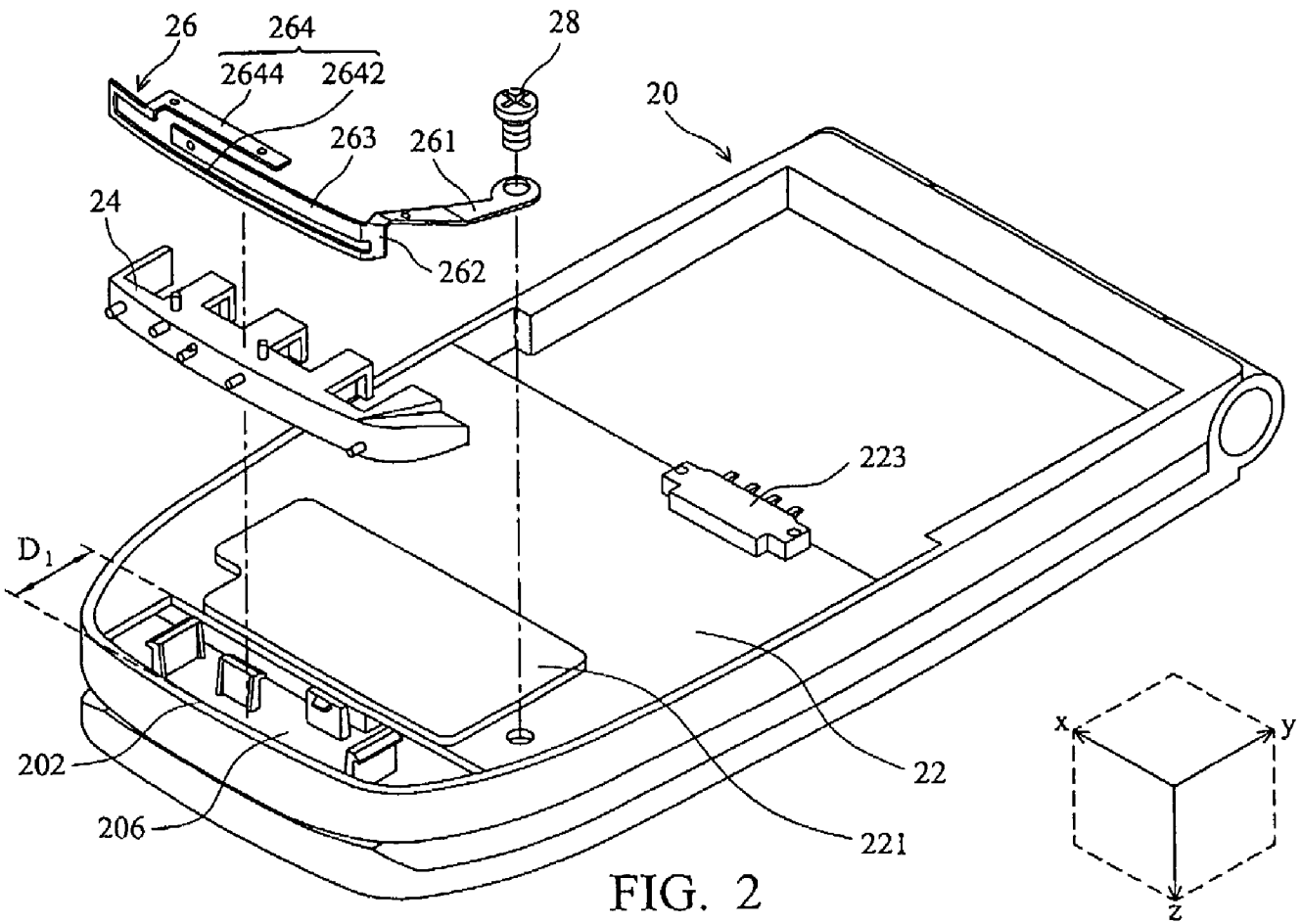
FIG. 2 is a perspective exploded diagram of the mobile communications device of FIG. 1.

Referring to FIGS. 1 and 2, a mobile communications device 20 (e.g. a cellular phone) includes a circuit board 22, a monopole antenna 26, and a mount 24. The circuit board 22 has a plurality of electronic components 221 and 223 mounted thereon and is spaced apart from the bottom edge 202 of the communications device 20 at a distance $D_1$ in the horizontal direction (y-direction). Thus, a clearance zone 206 is formed between the circuit board 22 and the bottom edge 202 of the communications device 20 for receiving the mount 24. In this embodiment, the monopole antenna 26 is made of phosphor bronze and the mount 24 is made of plastic. The monopole antenna 26 is affixed to the mount 26 by ultrasonic heat staking.

Figure 3A:
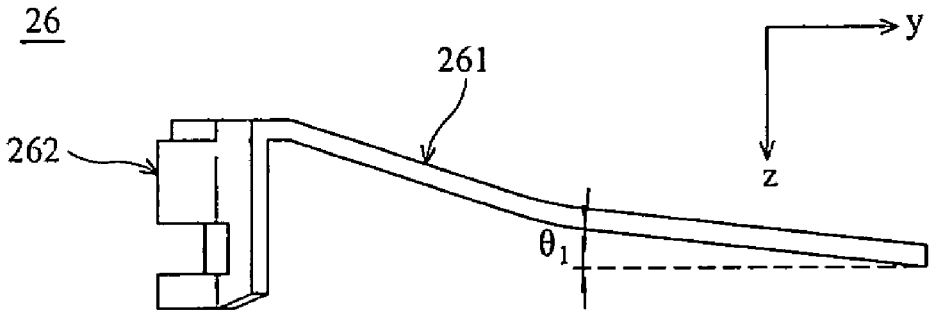
FIG. 3A depicts the monopole antenna of FIG. 2, observed from the x-direction.

The monopole antenna 26 includes a feed part 261, a connecting part 262 extending from the feed part 261, a first radiating part 263 extending from the feed part 261, and a second radiating part 264 also extending from the feed part 261. All parts of the monopole antenna 26 are described in detail in the following:

The feed part 261 of the monopole antenna 26 is electrically connected to the feed point (not shown) of the circuit board 22 and affixed by a screw 28. Referring to FIG. 3A, the feed part 261 is directed away from the circuit board 22 which is situated in a plane, at an angle $\theta_1$. In this embodiment, $\theta_1$ is about thirty degrees.

The connecting part 262 connects the feed part 261, the first radiating part 263, and the second radiating part 264. Note that the connecting part 262 runs substantially perpendicular to the circuit board 22.

Figure 3B:
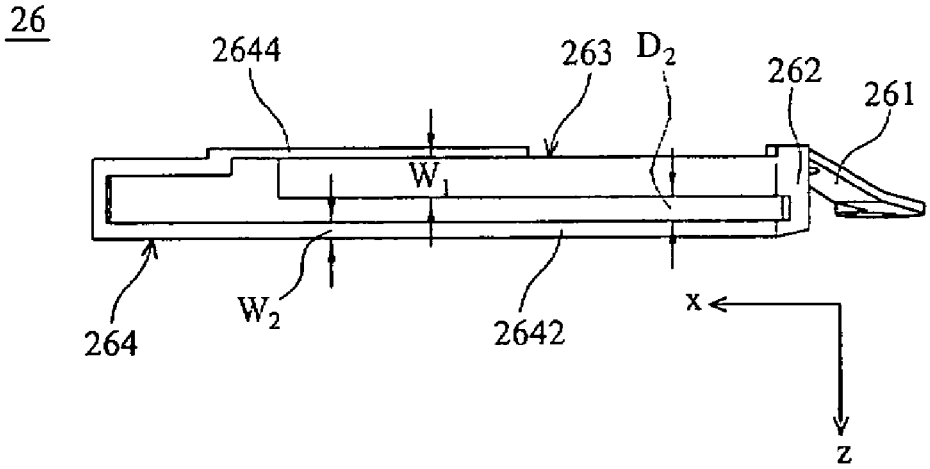
FIG. 3B depicts the monopole antenna of FIG. 2, observed from the y-direction.

The first radiating part 263 handles high frequency signals of 1710-1880 MHz and 1850-1990 MHz. Referring to FIG. 3B, the width $D_2$ of the first radiating part 263 is about 2 mm.

Figure 3C:
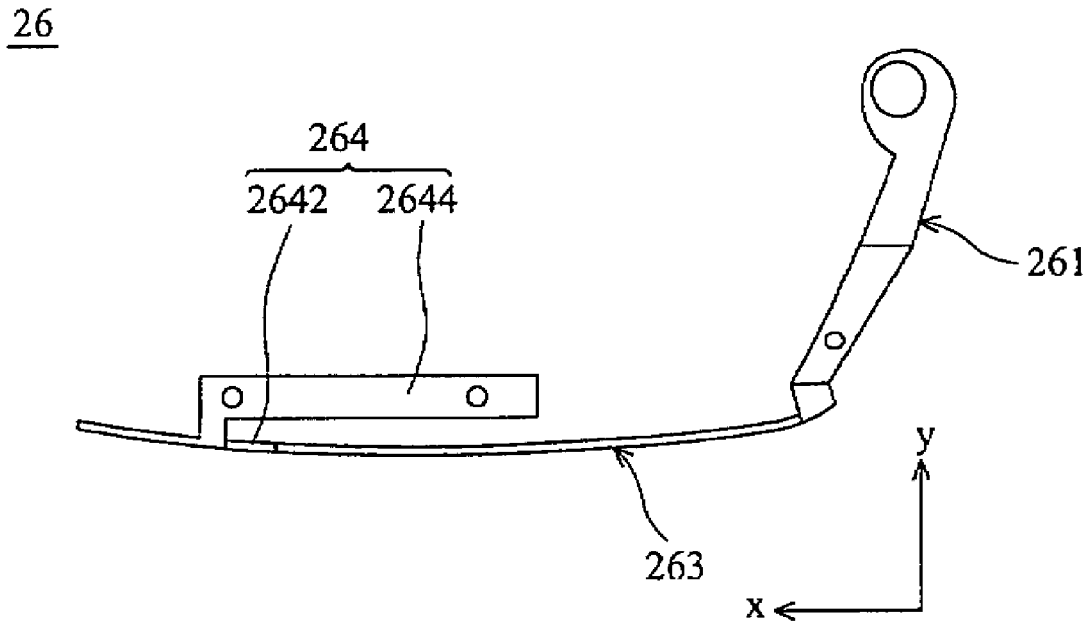
FIG. 3C depicts the monopole antenna of FIG. 2, observed from the z-direction.

The second radiating part 264 is longer than the first radiating part 263 for handling low frequency signals of 824-894 MHz and 880-960 MHz. The second radiating part 264 includes a first strip 2642 extending substantially parallel to the first radiating part 263 from the connecting part 262, and a second strip 2644 extending substantially parallel to the first radiating part 263 from the first strip 2642 toward the feed part 261 as shown in FIG. 3C. The distance $D_2$ between the first radiating part 263 and the first strip 2642 of the second radiating part 264 is very small in order to generate a coupling effect therebetween for promoting the radiation efficiency. In this embodiment, $D_2$=1 mm. The width $W_1$ of the first radiating part 263 exceeds the width $W_2$ of the first strip 2642 of the second radiating part 264. In this embodiment, $W_1$=2 mm and $W_2$=0.8 mm.

The invention provides a compact-sized three-dimensional monopole antenna capable of operating at frequencies of 824-894 MHz, 880-960 MHz, 1710-1880 MHz, and 1850-1990 MHz. Following experimentation, the monopole antenna requires only 6.8 mm clearance zone from the circuit board, thus eliminating clearance zone space, which can be used for arrangement of other electronic components in the mobile communications device or further device shrinkage.

Furthermore, the monopole antenna 26 made of phosphor bronze shows stable operating performance and is inexpensive. In addition, the monopole antenna 26 is affixed to the plastic mount 24 by ultrasonic heat staking, thus effectively simplifying the structure of the mobile communications device 20.

The feed part 261 of the monopole antenna 26 is firmly connected to the circuit board 22 by a screw 28, which is easy and fast during assembly. Furthermore, such a connection is reliable. Even when the mobile communications device 20 impacts the ground, the monopole antenna 26 does not separate from the circuit board 22.

Meanwhile, the positioning of the monopole antenna 26, disposed at the bottom of the mobile communications device 20, is distant from the receiver (not shown), thus significantly reducing specific absorption rate (SAR) in the human body.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communications device, comprising:

a circuit board;

a monopole antenna including a feed part electrically connected to the circuit board and directed away from the circuit board at an acute angle, a connecting part extending from the feed part in a direction substantially perpendicular to the circuit board, a first radiating part extending from the connecting part, and a second radiating part also directly extending from the connecting part, wherein the second radiating part includes a first strip substantially parallel to the first radiating part, and wherein the second radiating part further includes a second strip extending from the first strip toward the feed part.

2. The communications device as claimed in claim 1, wherein the acute angle is about thirty degrees.

3. The communications device as claimed in claim 1, wherein the first radiating part is about 1 mm from the first strip of the second radiating part.

4. The communications device as claimed in claim 1, wherein the first radiating part is wider than the first strip of the second radiating part.

5. The communications device as claimed in claim 1, wherein the first radiating part is about 2 mm in width.

6. The communications device as claimed in claim 1, wherein the first strip of the second radiating part is about 0.8 mm in width.

7. The communications device as claimed in claim 1, wherein the second strip of the second radiating part runs substantially parallel to the first radiating part.

8. The communications device as claimed in claim 1, further comprising a mount with the monopole antenna affixed thereto.

9. The communications device as claimed in claim 8, wherein the mount is made of plastic.

10. The communications device as claimed in claim 9, wherein the monopole antenna is affixed to the mount by ultrasonic heat staking.

11. The communications device as claimed in claim 1, wherein the monopole antenna is disposed at a bottom of the communications device.

12. The communications device as claimed in claim 1, wherein the circuit board is about 6.8 mm from an edge of the circuit board.

13. The communications device as claimed in claim 1, further comprising a screw affixing the feed part of the monopole antenna to the circuit board.

14. The communications device as claimed in claim 1, wherein the monopole antenna is made of phosphor bronze.

15. A monopole antenna, comprising:

a feed part directed away from a plane at an acute angle;

a connecting part extending from the feed part in a direction substantially perpendicular to the plane;

a first radiating part extending from the connecting part; and a second radiating part also directly extending from the connecting part; wherein the second radiating part includes a first strip substantially parallel to the first radiating part; and wherein the second radiating part further includes a second strip extending from the first strip toward the feed part.

16. The monopole antenna as claimed in claim 15, wherein the acute angle is about thirty degrees.

17. The monopole antenna as claimed in claim 15, wherein the first radiating part is about 1 mm from the first strip of the second radiating part.

18. The monopole antenna as claimed in claim 15, wherein the first radiating part is wider than the first strip of the second radiating part.

19. The monopole antenna as claimed in claim 15, wherein the first radiating part is about 2 mm in width.

20. The monopole antenna as claimed in claim 15, wherein the first strip of the second radiating part is about 0.8 mm in width.

21. The monopole antenna as claimed in claim 15, wherein the second strip of the second radiating part runs substantially parallel to the first radiating part.

22. The monopole antenna as claimed in claim 15, wherein the monopole antenna is made of phosphor bronze.

* * * * *